US005563332A

United States Patent [19]

Yasuda

[11] Patent Number: 5,563,332

[45] Date of Patent: Oct. 8, 1996

[54] APPARATUS FOR DETECTING MISFIRE IN INTERNAL COMBUSTION ENGINE

[75] Inventor: Yukio Yasuda, Itami, Japan

[73] Assignee: Mitsubishi Denki Kabushiki Kaisha, Tokyo, Japan

[21] Appl. No.: 429,774

[22] Filed: Apr. 27, 1995

[30] Foreign Application Priority Data

Dec. 15, 1994 [JP] Japan ..... 6-312134

[51] Int. Cl.[6] ..... F02P 17/00; F02P 3/04

[52] U.S. Cl. ..... 73/35.08; 73/35.01; 324/399; 324/464

[58] Field of Search ..... 324/378, 399, 324/464, 72; 73/35.08, 35.01

[56] References Cited

U.S. PATENT DOCUMENTS 5,424,647 6/1995 Ohsawa ..... 324/399

5,483,818 1/1996 Brandt ..... 73/35.08

*Primary Examiner*—Kenneth A. Wieder
*Assistant Examiner*—Jose M. Solis
*Attorney, Agent, or Firm*—Leydig, Voit & Mayer

[57] ABSTRACT

An apparatus for detecting a misfire in an internal combustion engine arranged so that a leak current caused when the insulation of an ignition plug is compensated. An ion current and the leak current can easily be discriminated from each other, whereby the ion current detection accuracy can be improved. The apparatus is provided with a biasing capacitor which is charged with a current flowing at the time of discharge through the ignition plug, a Zener diode for setting the voltage at which the capacitor is charged by this charging, a first semiconductor integrated circuit which detects the charging current flowing through the capacitor and thereafter outputs a control current through a predetermined time period, and which holds a peak value of a voltage converted from the ion current and detects the ion current by comparing the converted voltage value of the ion current and the held peak value.

12 Claims, 9 Drawing Sheets

APPARATUS FOR DETECTING MISFIRE IN INTERNAL COMBUSTION ENGINE

BACKGROUND OF THE INVENTION

1. Field of the Invention

This invention relates to an apparatus for detecting misfire in an internal combustion engine on the basis of detection of an ion current through an ignition plug provided in a combustion chamber of the internal combustion engine.

2. Description of the Related Art

In internal combustion engines, a mixture of fuel and air is compressed in a combustion chamber and a spark is caused by applying a high voltage to an ignition plug provided in the combustion chamber to ignite and burn the mixture. Failure to cause burning of the mixture is called misfire. If misfire occurs, the desired power of the internal combustion engine cannot be obtained and the mixture containing a large amount of fuel flows into the exhaust system to corrode the exhaust pipe and other parts. Therefore, there is a need to detect a misfiring state and to warn a driver.

As a means for detecting misfire in an internal combustion engine, a circuit for detecting misfire by detecting an ion current flowing through an ignition plug provided in a combustion chamber is known. As fuel burns in the combustion chamber, molecules in the combustion chamber are ionized. When a voltage is applied to the ionized gas in the combustion chamber through the ignition plug, a small current flows, which is called ion current. The ion current is reduced to a very small value when misfire occurs. Occurrence of misfire can be determined by detecting such a change in ion current.

FIG. 8 is a diagram of this kind of conventional misfire detecting apparatus for use with an internal combustion engine.

Referring to FIG. 8, an ignition coil 1 has a primary coil 1*a* and a secondary coil 1*b*, and an ignition plug 2 provided in an internal combustion engine 2A is connected to a minus terminal of the secondary coil 1*b*. A plus terminal of the primary coil 1*a* is connected to a power source 4 while a minus terminal of the primary coil 1*a* is connected to the collector of a current switching transistor 3. The emitter of the transistor 3 is grounded, and the base of the transistor 3 is connected to a controller (not shown) for controlling combustion.

A misfire detection circuit 5 has a biasing capacitor 6 connected to a plus terminal of the secondary coil 1*b* to bias the ignition plug 2, a Zener diode 7 connected between the plus terminal of the secondary coil 1*b* and ground to set a voltage at which the capacitor 6 is charged, a charging diode 8 connected between the low potential side of the capacitor 6 and ground with its anode connected to the capacitor 6, an ion current converting resistor 9 also connected between the low potential side of the capacitor 6 and ground, and a capacitor 10 having one end connected to the low potential side of the capacitor 6 and having the other end connected to a connection point between resistors 11*a* and 11*b* connected in series between the power source and ground. The capacitor 10 and the resistors 11*a* and 11*b* form a high-pass filter.

The misfire detection circuit 5 also has a comparator 12 having a noninverting input terminal connected to the connection point between the high-pass filter capacitors 11*a* and 11*b* and having an inverting input terminal connected to a connection point between resistors 13*a* and 13*b* for setting a comparison reference voltage which are connected in series between the power source and ground. The comparator 12 detects the existence/non-existence of an ion current by comparing a voltage change caused by an ion current with the reference voltage. Further, one end of a resistor 14 is connected to the plus terminal of the primary coil 1*a* of the ignition coil 1, and a power stabilizing capacitor 15 and a voltage regulating diode 16 are connected between the other end of the resistor 14 and ground, thereby forming a power supply circuit of the misfire detection circuit 5.

In the thus-arranged circuit, when the internal combustion engine is ignited, the transistor 3 is abruptly changed from the ON state to the OFF state by the control of the controller for controlling combustion (not shown). At this time, the primary current of the ignition coil 1 decreases abruptly, so that a counter electromotive force is generated on the primary side to cause a voltage rise up to the collector-emitter withstand voltage of the transistor 3 (about 300 V). Simultaneously, on the secondary side of the ignition coil 1, the voltage generated on the primary side appears by being amplified by the ratio of the numbers of turns of the primary coil 1*a* and the secondary coil 1*b*. As a result, for example, a voltage of about −30 kV, is applied to the electrode of the ignition plug 2 to cause a spark.

In the circuit shown in FIG. 8, ignition energy is utilized to accumulate, in the capacitor 6, an amount of charge large enough to detect an ion current, and the voltage held by the capacitor 6 provides a high voltage of, for example, about 80 V set by the Zener diode 7 and applied to the ignition plug 2 immediately after ignition. A current thereby caused is detected as ion current. The current at the time of ignition flows in the direction opposite to the direction of arrow I5 in FIG. 8, and causes discharge at the ignition plug 2 to ignite and explode the air-fuel mixture in the combustion chamber 2A. This discharge current charges the capacitor 6 to the voltage limited by the Zener diode 7.

The ion current detecting operation of the misfire detection circuit 5 will be described with reference to the operation timing chart of FIG. 9, which represents a case where no leak current such as that mentioned later occurs.

The operation of the transistor 3 is controlled by the controller for controlling combustion (not shown). The transistor 3 is in the OFF state when the base voltage $V_3$ is low level and in the ON state when the base voltage $V_3$ is high level. When the base voltage $V_3$ of the transistor 3 is changed from high level to low level, the potential $V_2$ of the ignition plug 2 is reduced to, for example, about −30 kV by the counter electromotive force of the coil to cause a spark. As long as a voltage high enough to produce the spark is maintained, the ignition current flows in the direction opposite to the direction of arrow I5 in FIG. 8 to cause a voltage drop across the diode 8, so that the output after the bypass filter, i.e., the potential $V_{12+}$ of the noninverting input terminal of the comparator 12, rises.

When the ignition circuit becomes unable to maintain the spark, the potential $V_2$ of the ignition plug 2 rises abruptly to become equal to the voltage $V_6$ (e.g., 80 V) held by the capacitor 6. At this time, by the application of the positive voltage $V_6$ of the capacitor 6, an-ion current is caused to flow in the direction of arrow I5 shown in FIG. 8. The current in the direction of arrow I5 flows through the resistor 15 to cause a voltage drop. As a result, the potential $V_{12+}$ of the noninverting input terminal of the comparator 12 becomes lower in proportion to the ion current. This ion current is generated immediately after ignition and ceases to flow in several milliseconds.

The above-described comparator 12 detects the existence/nonexistence of ion current by comparing a change in the potential $V_{12+}$ of the noninverting input terminal due to an ion current with the potential $V_{12-}$ of the inverting input terminal set to the comparison reference voltage set value by the resistors 13*a* and 13*b*. In this example, when the potential $V_{12+}$ of the noninverting input terminal of the comparator 12 becomes lower than the potential $V_{12-}$ of the inverting input terminal, the potential $V_{12out}$ of the output terminal becomes low level, thereby detecting ion current. When no ion current is detected, the potential $V_{12out}$ of the output terminal is high level.

The above-described apparatus for detecting misfire in the internal combustion engine entails a problem described below. If carbon or the like is attached to the ignition plug 2 in the combustion chamber 2A, the insulation resistance of the ignition plug 2 is reduced. The ignition plug 2 can spark strongly enough for the operation of the internal combustion engine if the insulation resistance is higher than about 1 MΩ. However, when a voltage is applied to the ignition plug 2 having a reduced insulation resistance, a certain leak current occurs which is determined by the applied voltage and the insulation resistance. At the time of ion current detection, such a leak current appears in a state of being superposed on an ion current.

That is, if the leak current thus generated is small, it is proportional to the voltage of the capacitor 6 since it is proportional to the applied voltage, and it is constant because the voltage of the capacitor 6 is constant. In this case, a voltage signal due to the leak current and having a small change with respect to time attenuates by the effect of the high-pass filter formed by the capacitor 10 and the resistors 11*a* and 11*b*, while only a signal due to the ion current and having a large change with respect to time passes the filter. As a result, the ion current can be detected normally. However, if the leak current is increased, the variation in the voltage of the capacitor 6 becomes so large that the leak current and the ion current cannot be discriminated from each other.

Such a bad influence of an increase in leak current will be explained with reference to FIG. 10 in comparison with FIG. 9.

The voltage $V_6$ of the capacitor 6 has the value limited by the Zener diode 7 during the ignition period. When ignition is completed, discharge by the above-described leak current starts to reduce the voltage $V_6$ with a time constant determined by the capacitance of the capacitor 6 and an insulation resistance of the ignition plug 2. Simultaneously, the potential $V_2$ of the ignition plug 2 is also reduced because the voltage determined by the Zener diode 7 and held by the capacitor 6 (e.g., 80 V) cannot be maintained. Accordingly, by the influence of this leak current, a state continues where the potential $V_{12+}$ of the noninverting input terminal of the comparator 12 is smaller than the potential $V_{12-}$ of the inverting input terminal set to the comparison reference voltage set value, even though an ion current is generated immediately after ignition and ceases to flow in several milliseconds. During this state, the potential $V_{12out}$ of the output terminal of the comparator is low level. As a result, a detection is erroneously made to determine the existence of an ion current, even if no ion current flows, thus reducing the ion current detection accuracy.

SUMMARY OF THE INVENTION

In view of the above-described problem of the conventional art, an object of the present invention is to provide an apparatus for detecting misfire in an internal combustion engine in which a voltage held by a capacitor is prevented from dropping due to the influence of a leak current caused with a reduction in the insulation resistance of an ignition plug, whereby an ion current and leak current can easily be discriminated from each other so that the ion current detection accuracy is improved.

To achieve this object, according to the present invention, there is provided an apparatus for detecting a misfire in an internal combustion engine comprising: an ignition coil having a primary coil and a secondary coil, a power source being connected to one end of the primary coil, a switching device being connected to the other end of the primary coil and controlled to perform switching in accordance with the ignition timing of the internal combustion engine; an ignition plug connected to one end of the secondary coil of the ignition coil and capable of causing a spark in a combustion chamber of the internal combustion engine to ignite an air-fuel mixture when a high voltage is applied to the ignition plug; a biasing capacitor connected to the other end of the secondary coil, the biasing capacitor being charged with a current flowing through the ignition plug by discharge from the secondary coil, the biasing capacitor applying the voltage at which it has been charged to the ignition plug as a biasing voltage; a Zener diode connected between a high potential side of the biasing capacitor and ground to set the voltage at which the biasing capacitor is charged; a first semiconductor integrated circuit connected to the low potential side of the biasing capacitor, the first semiconductor integrated circuit detecting the charging current flowing through the biasing capacitor and thereafter outputting a control current through a predetermined time period, the first semiconductor integrated circuit also holding a peak value of a voltage converted from the ion current and detecting the ion current by comparing the converted voltage value of the ion current and the held peak value; and a second semiconductor integrated circuit having a substrate potential set higher than a substrate potential of the first semiconductor integrated circuit, the second semiconductor integrated circuit being connected to the low potential side of the biasing capacitor to supply a negative bias voltage to the biasing capacitor to reduce the potential at the low potential side of the capacitor by a value corresponding to the voltage held by the biasing capacitor during a time period when the control current is not output, the second semiconductor integrated circuit converting the ion current due to combustion caused by the ignition plug into the voltage and outputting the converted voltage value.

In the apparatus for detecting misfire in an internal combustion engine in accordance with the present invention, a time period through which the operation of detecting an ion current is not performed is provided and the voltage held by the biasing capacitor is prevented from dropping during this time period, thereby ensuring that an ion current and a leak current can easily be discriminated from each other so that the ion current detection accuracy is improved even if the insulation resistance of the ignition plug is reduced.

DESCRIPTION OF THE PREFERRED EMBODIMENT

An embodiment of the present invention will be described below with reference to the accompanying drawings.

Figure 8:
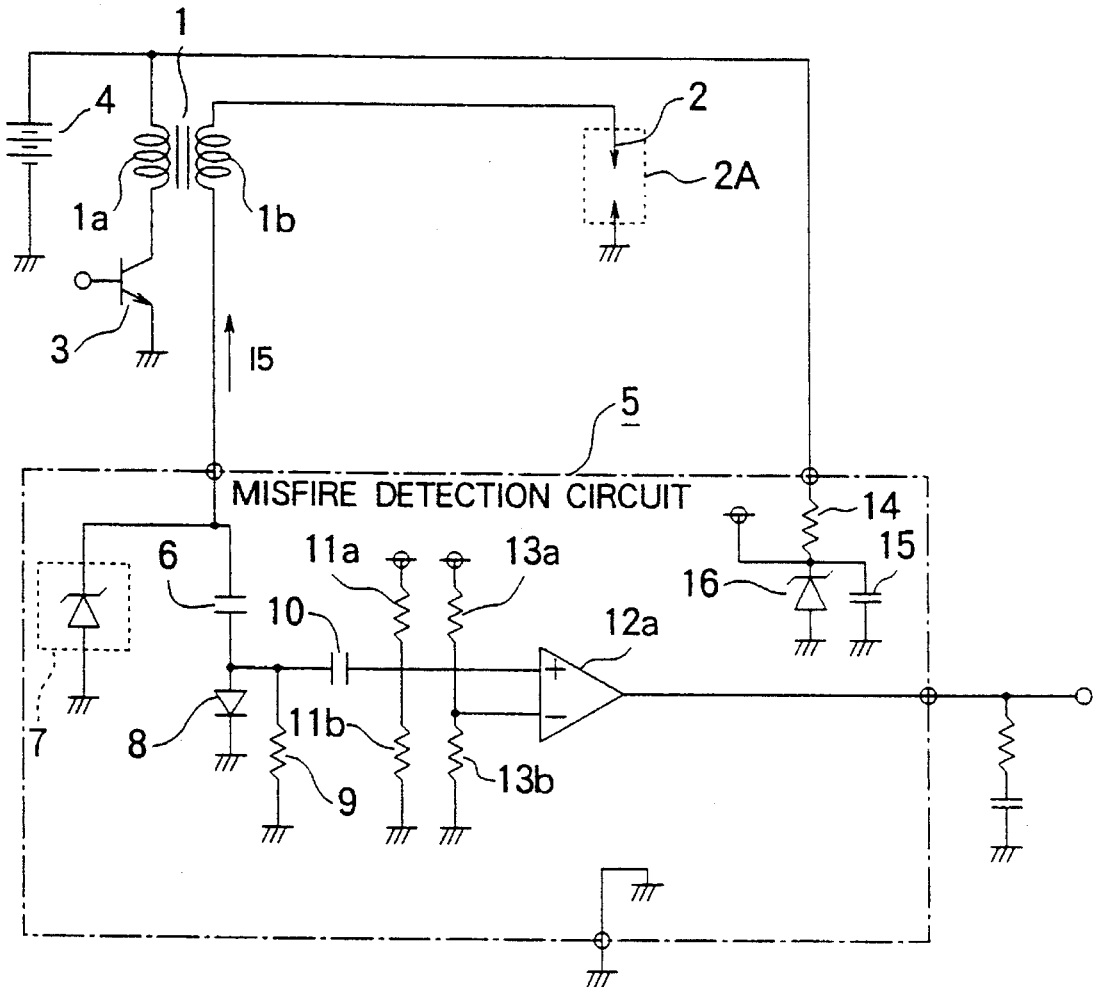
FIG. 8 is a diagram of the configuration of a conventional internal combustion engine misfire detection apparatus.
Figure 9:
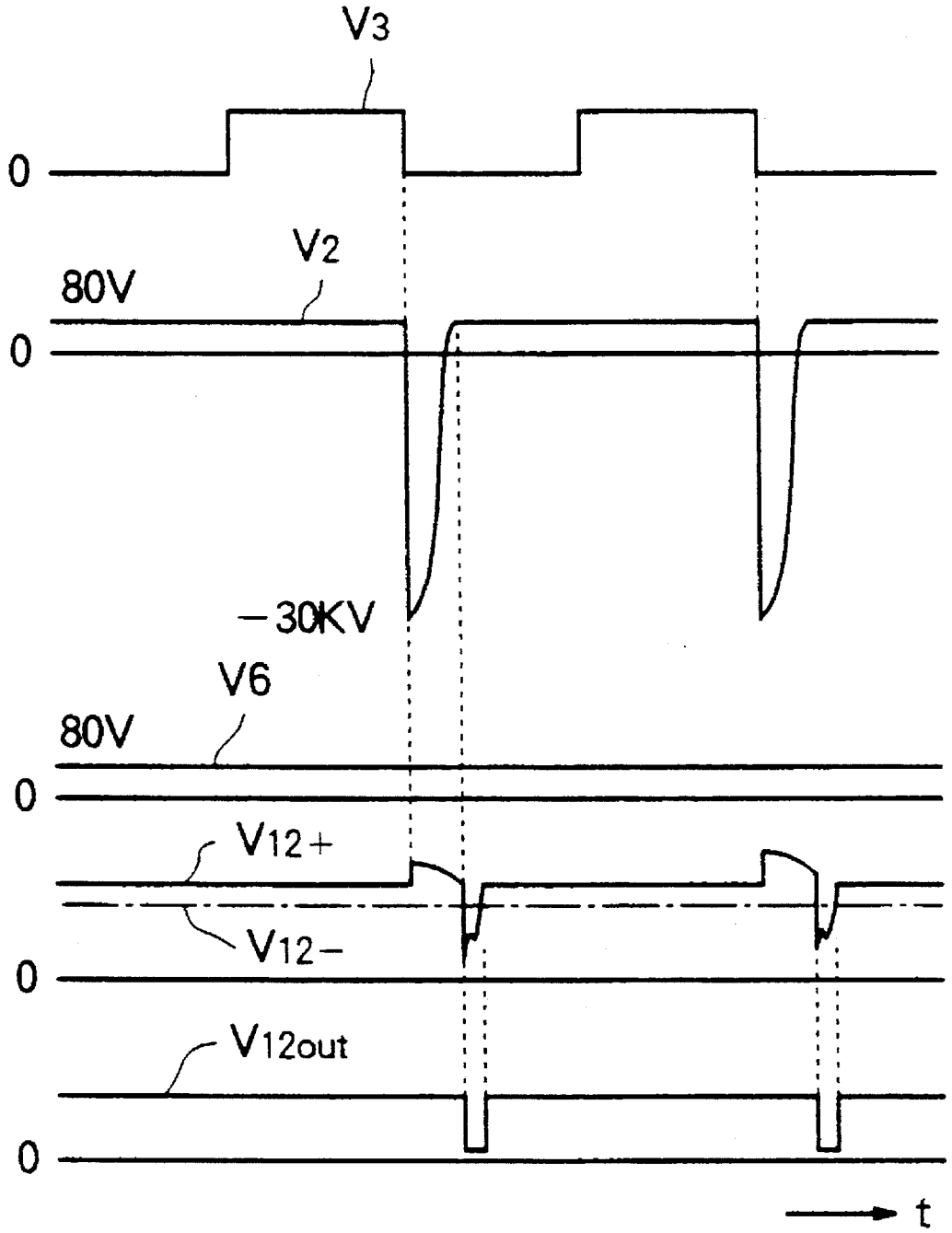
FIG. 9 is a waveform diagram showing the operation of the conventional art in a case where there is no leak current.
Figure 10:
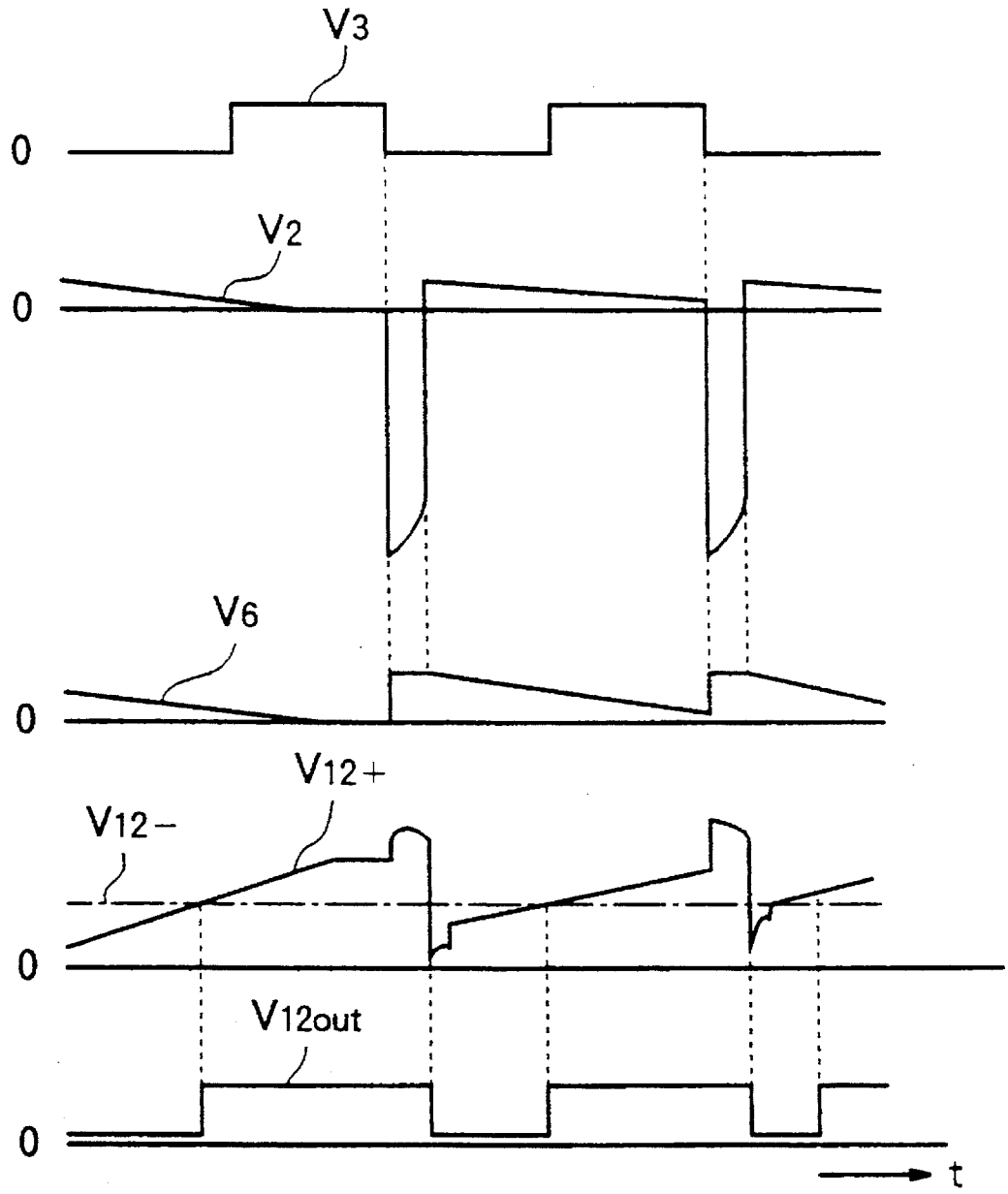
FIG. 10 is a waveform diagram showing the operation of the conventional art in a case where there is a leak current.

An apparatus for detecting misfire in an internal combustion engine in accordance with an embodiment of the present invention has components 1 to 4, 6 to 8, 14, and 15 which are identical or corresponding to those of the internal combustion engine misfire detection apparatus shown in FIG. 8. An ignition coil 1 has a primary coil 1*a* and a secondary coil 1*b*. A power source 4 is connected to a plus terminal of the primary coil 1*a*, and a transistor 3 which is operated to perform switching in accordance with the ignition timing of the internal combustion engine is connected to a minus terminal of the primary coil 1*a*. An ignition plug 2 is connected to a minus terminal of the secondary coil 1*b*, and a misfire detection circuit 50 is connected to a plus terminal of the secondary coil 1*b*. The ignition plug 2 sparks by a high voltage generated at the minus terminal of the secondary coil 1*b* of the ignition coil 1. The transistor 3 provided as a current switching device has its collector connected to the minus terminal of the primary coil 1*a* of the ignition coil 1 and its emitter grounded, and is controlled through its base by a controller (not shown) for controlling combustion. The plug 2 is provided in a combustion chamber 2A.

The misfire detection circuit 50 is specifically arranged in accordance with the embodiment of the present invention to improve the ion current detection accuracy even if the insulation resistance is reduced in such a manner that a certain period of time is set in which the operation of detecting an ion current is not performed, and a reduction in the voltage of the biasing capacitor 6 is prevented through this time period. The misfire detection circuit 50 includes the biasing capacitor 6 connected to the plus terminal of the secondary coil 1*b* to bias the ignition plug 2, a Zener diode 7 connected between the plus terminal of the secondary coil 1*b* and ground to set a voltage at which the capacitor 6 is charged, a power supply resistor 14 having one end connected to the power source 4, and a power supply stabilizing capacitor 15 provided between the other end of the resistor 14 and ground.

A first semiconductor integrated circuit 16 is also provided which includes as circuit blocks a charging detection circuit 17 which is connected to the low potential terminal of the biasing capacitor 6 and which detects a charging current through the capacitor 6 and thereafter outputs a control current for a predetermined period of time, a waveform shaping circuit 18 which holds a peak value of a voltage converted from an ion current and detects the ion current by comparison between the voltage converted value of the ion current, and a power supply circuit 19.

A second semiconductor integrated circuit 20 is formed on a circuit board separate from that for the semiconductor integrated circuit 16. The second semiconductor integrated circuit 20 includes an ion current-voltage converter circuit 21 which is connected to the low potential side of the biasing capacitor 6, which supplies a negative bias to reduce the voltage at the low potential side of the capacitor 6 by a value corresponding to the voltage held by the capacitor 6 during the period of time when the above-mentioned control current is not output, and which converts an ion current through the ignition plug 2 during combustion into a voltage and outputs the converted voltage value. The second semiconductor integrated circuit 20 also includes a diode 22 for fixing and unfixing the substrate potential of the second semiconductor integrated circuit 20.

A time counting capacitor 23, a peak holding capacitor 24 and a feedback resistor 25 for ion current-voltage conversion are further provided. The time counting capacitor 23 and the peak holding capacitor 24, provided separately from the first semiconductor integrated circuit 16 in the embodiment shown in FIG. 1, may alternatively be incorporated in the first semiconductor integrated circuit 16. Similarly, the feedback resistor 25 for ion current conversion may be provided in the second semiconductor integrated circuit 20 according to the conversion accuracy.

Figure 1:
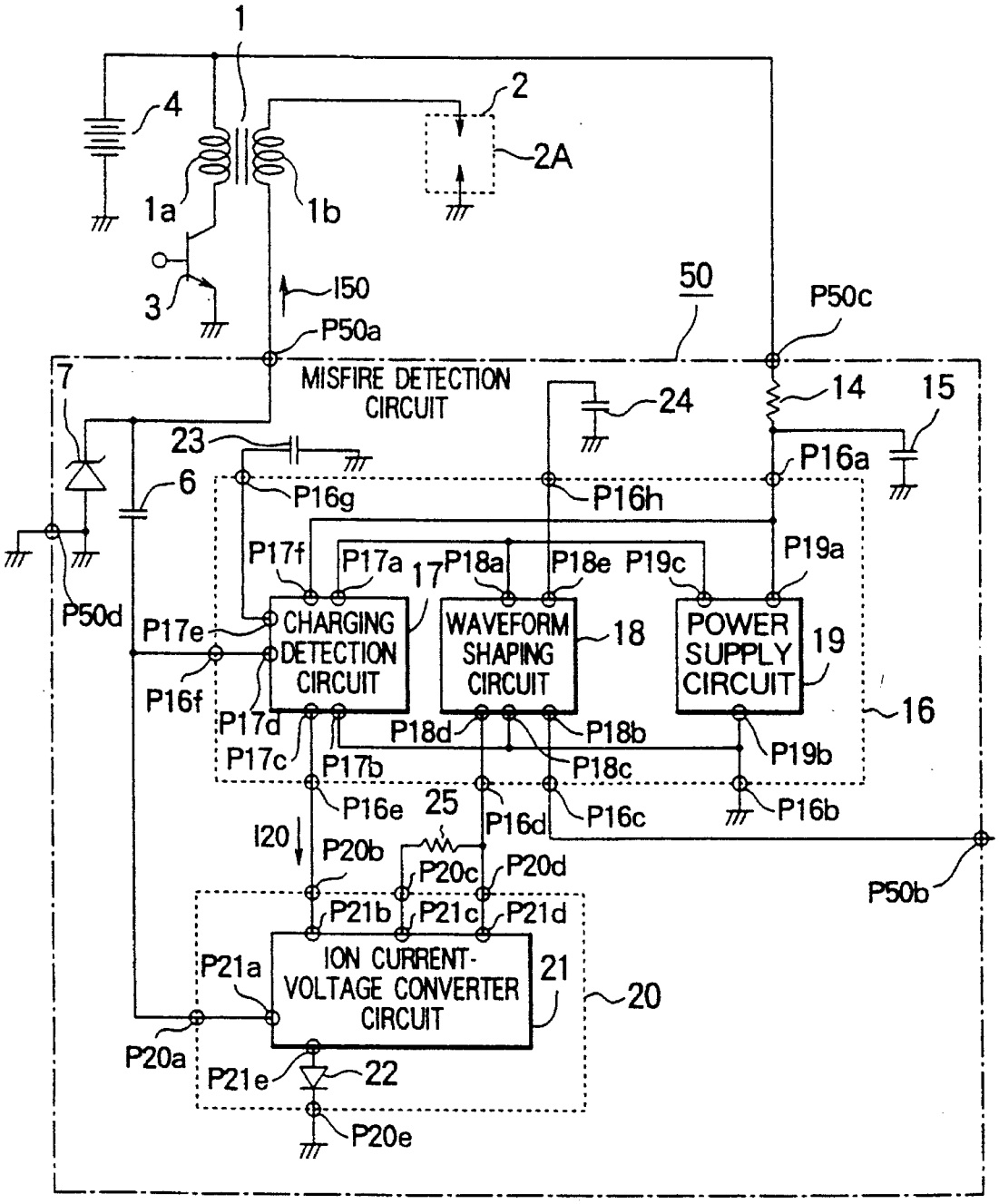
FIG. 1 is a diagram of the coverall configuration of an internal combustion engine misfire detection apparatus in accordance with an embodiment of the present invention.

The misfire detection circuit 50 shown in FIG. 1 has terminals $P_{50a}$ to $P_{50d}$, i.e., an input terminal $P_{50a}$ connected to the high potential side of the biasing capacitor 6 connected to the plus terminal of the secondary coil 1*b* of the ignition coil 1, an output terminal $P_{50b}$, a power supply terminal $P_{50c}$ connected to the power source 4, and a grounding terminal 50*d* through which the Zener diode 7 is grounded. The first semiconductor integrated circuit 16 has terminals $P_{16a}$ to $P_{16h}$, i.e., a power supply terminal $P_{16a}$ which connects a terminal $P_{17g}$ of the charging detection circuit 17 and a terminal $P_{19a}$ of the power supply circuit 19 to the power supply terminal $P_{50c}$ of the misfire detection circuit 50 through the power supply resistor 14. A grounding terminal $P_{16b}$ is provided which connects to a terminal $P_{17b}$ of the charging detection circuit 17, a terminal $P_{18c}$ of the waveform shaping circuit 18 and a terminal $P_{19b}$ of the power supply circuit 19. An output terminal $P_{16c}$ is provided which connects a terminal $P_{18b}$ of the waveform shaping circuit 18 to the output terminal $P_{50b}$ of the misfire detection circuit 50, a control input terminal $P_{16d}$ is provided which connects the resistor 25 and a terminal $P_{20d}$ of the second semiconductor integrated circuit 20 to a terminal $P_{18d}$ of the waveform shaping circuit 18, a detection output terminal $P_{16e}$ is provided which connects a terminal $P_{20b}$ of the second semiconductor integrated circuit 20 to a terminal $P_{17c}$ of the charging detection circuit 17. A detection input terminal $P_{16f}$ is provided which connects the low potential side of the biasing capacitor 6 and a terminal $P_{17d}$ of the charging detection circuit 17. A time measuring terminal $P_{16g}$ is provided which connects the high potential terminal of the time measuring capacitor 23 and a terminal $P_{17e}$ of the charging detection circuit 17. A peak holding terminal $P_{16b}$ is provided which connects the high potential side of the peak holding capacitor 24 and a terminal $P_{18e}$ of the waveform shaping circuit 18. The second semiconductor integrated circuit 20 has terminals $P_{20a}$ to $P_{20e}$, which are an input terminal, a control input terminal, a first control output terminal, a second control output terminal and a grounding terminal, respectively.

In this embodiment, a certain period of time when the operation of detecting an ion current is not performed is provided and a reduction in the voltage of the biasing capacitor 6 is prevented in this time period even if the insulation resistance of the ignition plug 2 is reduced, thereby maintaining the ion current detection accuracy. First, the voltage of the capacitor 6 can be prevented from dropping if the bias voltage to ignition plug 2 is set to zero. In such a case, since the biasing capacitor 6 maintains the bias voltage of about 80 V, the potential on the low potential side of the biasing capacitor 6 may be reduced by a value corresponding to the voltage held by the capacitor 6. In other words, it is necessary that no current flows even if the circuit connected to the low voltage side of the biasing capacitor 6 is negatively biased.

If negative biasing (application of a voltage lower than the substrate potential) is effected by using a semiconductor integrated circuit, a problem relating to a parasitic element on the substrate arises. More specifically, the collector of an npn transistor, the base of a pnp transistor and the like are formed by n type diffusion, and, if a voltage lower than the substrate potential is applied, the pn connection to the substrate is biased in the forward direction. Even if there is no parasitic element, the withstand voltage of the base of an npn transistor is so low that the base breaks down by several volts. Elements to which a voltage lower than the substrate potential can be applied are the collector and the emitter of a pnp transistor and a diffusion resistor.

It is very difficult to form a misfire detection circuit using an operational amplifier under such restrictions. In the misfire detection circuit of this embodiment, to avoid such disadvantageous restrictions, the entire circuit is separated into the first semiconductor integrated circuit 16 having a fixed substrate potential and the second semiconductor integrated circuit 20 having an unfixed substrate potential, and the second semiconductor integrated circuit 20 is controlled by the operation of the first semiconductor integrated circuit 16.

If this arrangement is adopted, it is possible to freely form the circuit while achieving the desired effect of preventing a reduction in the voltage of the biasing capacitor 6.

Figure 2:
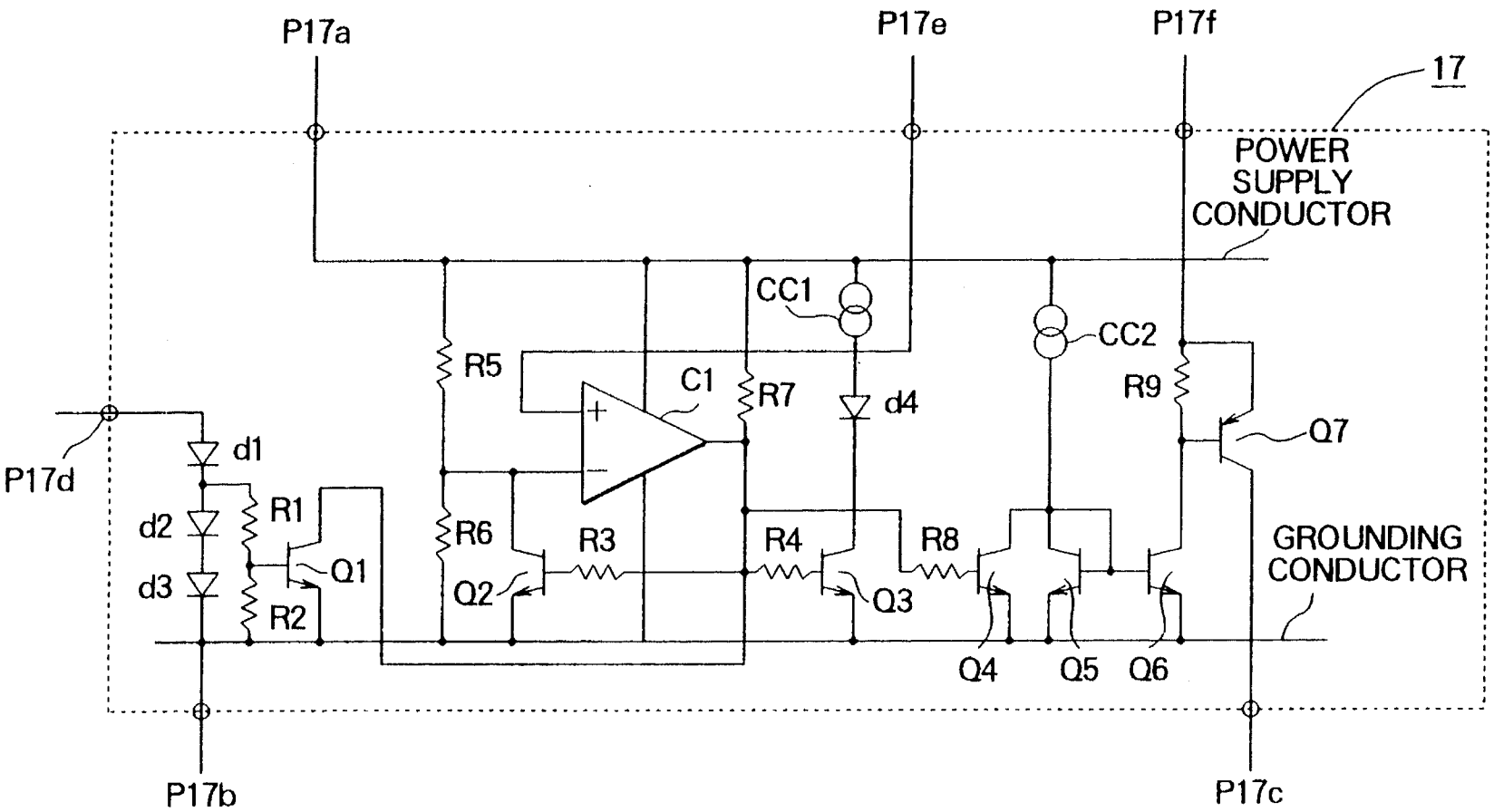
FIG. 2 is a diagram of a charging detection circuit 17 provided in a first semiconductor integrated circuit 16 shown in FIG. 1.

The charging detection circuit 17 in the first semiconductor integrated circuit 16 has a configuration such as that shown in FIG. 2.

Diodes d1 to d3 are connected in series between the terminal $P_{17d}$ connected to the low potential side of the biasing capacitor 6 and the terminal $P_{17b}$ connected to the grounding terminal $P_{16b}$ of the first semiconductor integrated circuit 16 in the direction in which the charging current flows to the biasing capacitor 6. A series combination of resistors R1 and R2 is connected between a connection point between the diodes d1 and d2 and a grounding conductor. An npn transistor Q1 is provided which has its base connected to a connection point between the resistors R1 and R2 and has its emitter connected to the grounding conductor. The transistor Q1 is turned on by the charging current flowing to the biasing capacitor 6 in the direction opposite to I50 in FIG. 1.

Npn transistors Q2 and Q3 having their bases connected to each other through resistors R3 and R4 are connected to the collector of the transistor Q1 through a connection point between the resistors R3 and R4. The collector of the transistor Q2 is connected to a connection point between resistors R5 and R6 which are connected in series between a power supply conductor from the terminal $P_{17a}$ connected to the power supply circuit 19 shown in FIG. 1 and the grounding conductor. The collector of the transistor Q2 is also connected to an inverting input terminal of a comparator C1. The collector of the transistor Q3 is connected to the power supply conductor through a constant-current circuit CC1 and a diode d4. A noninverting input terminal of the comparator C1 is connected to the time measuring capacitor 23 shown in FIG. 1 through a connection point between the constant-current circuit CC1 and the diode d4 and through the terminal $P_{17e}$. An output terminal of the comparator C1 is connected to the power supply conductor through a resistor R7 and to the connection point between the resistors R3 and R4. When the transistor Q1 is turned on, the transistors Q2 and Q3 are turned off to change the output of the comparator C1 from a high level in a stable state to a low level. A charging current is thereby output through the terminal P17*e* to charge the time measuring capacitor 23 connected to the noninverting input terminal of the comparator C1 and the constant-current circuit CC1 through the terminal $P_{17e}$. This charging is continued until the charged voltage becomes equal to the voltage of the inverting input terminal of the comparator C1.

Further, the base of an npn transistor Q4 is connected to the output terminal of the comparator C1 through a resistor R8. The collector of the transistor Q4 is connected to one terminal of a constant-current circuit CC2 along with the collector and the base of and npn transistor Q5. Another terminal of the constant-current circuit CC2 is connected to the power supply conductor. An npn transistor Q6 has its base connected to the same connection point as the base of the transistor Q5 and its collector connected through a resistor R9 to the terminal P17*f* connected to the power supply resistor 14 shown in FIG. 1. An pnp transistor Q7 is provided which has its emitter and base connected to the two ends of the resistor R9, and which has its collector connected through the terminal $P_{17c}$ to the terminal $P_{20b}$ of the second semiconductor integrated circuit 20 shown in FIG. 1. When the output of the comparator C1 is low level, that is, during the period of time through which the voltage to the noninverting input terminal of the comparator 1 maintains the charging state, the transistor Q4 is off and a current from the constant-current circuit CC2 flows through the transistor Q6. The pnp transistor Q7 is thereby turned on to output a current through the terminal $P_{17c}$. That is, a current is caused to flow from the first semiconductor integrated circuit 16 to the second semiconductor integrated circuit 20 in the direction of I20 shown in FIG. 1.

Figure 3:
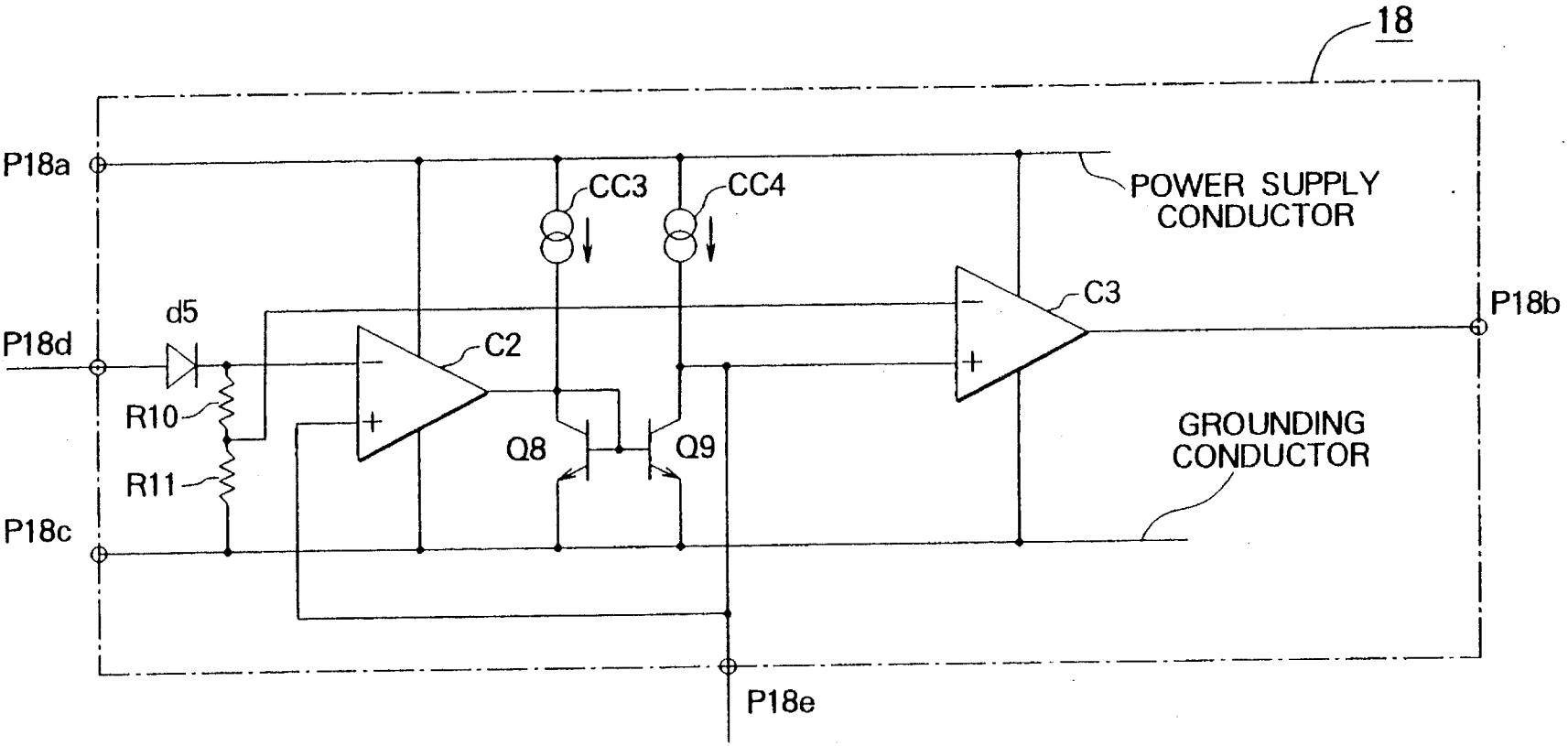
FIG. 3 is a diagram of a waveform shaping circuit provided in the first semiconductor integrated circuit 16 shown in FIG. 1.

The waveform shaping circuit 18 in the first semiconductor integrated circuit 16 has a configuration such as that shown in FIG. 3.

At the terminal $P_{18d}$ connected to the second semiconductor integrated circuit 20 described later, a diode d5 is provided in such a direction that the output from the ion current-voltage convention circuit 21 in the second semiconductor integrated circuit 20 flows into the waveform shaping circuit 18. The cathode of the diode d5 is connected to an inverting input terminal of a peak holding comparator C2, and resistors R10 and R11 are connected between the cathode and a grounding conductor connected to the terminal $P_{18c}$. A constant-current circuit CC3 is provided between an output terminal of the comparator C2 and a power supply conductor from the terminal $P_{18a}$ connected to the power supply circuit 19 shown in FIG. 1. A transistor Q8 is provided between the output terminal of the comparator C2 and the grounding conductor by having its base and collector connected to the output terminal of the comparator 2 and its emitter connected to the grounding conductor. A transistor Q9 is connected which has its base connected to the same connection point as the base of the transistor Q8. A constant-current circuit CC4 is connected between the collector of the transistor Q9 and the power supply conductor. The collector of the transistor Q9 is connected to the terminal $P_{18e}$ to which the peak holding capacitor 24 shown in FIG. 1 is connected. Noninverting input terminals of the peak holding comparator C2 and a waveform shaping comparator C3 are also connected to the terminal $P_{18e}$. The emitter of the transistor Q9 is connected to the grounding conductor. An output terminal of the waveform shaping comparator C3 is connected to the terminal $P_{18b}$ connected to the output terminal $P_{50b}$ of the first semiconductor integrated circuit 16.

Input and output currents through the terminal $P_{18e}$ connected to the peak holding capacitor 24 depend upon constant-current values of the constant-current circuits CC3 and CC4, and are changed by the operation of the peak holding comparator C2. When the output of the comparator C2 is high, a current from the peak holding capacitor 24 flows in through the terminal $P_{18e}$. When the output of the comparator C2 is low, a current flows out to the peak holding capacitor 24 through the terminal $P_{18e}$ so that the peak holding capacitor 24 holds a peak of the inverting input voltage of the peak holding comparator C2. The waveform shaping comparator C3 receives as an inverting input a signal which is formed by dividing the voltage of the inverting input of the peak holding comparator C2 by the resistors R10 and R11. The comparator C3 receives as a noninverting input the above-mentioned held peak voltage to detect only a signal higher than the held peak voltage at least by a certain value. The output of the comparator C3 becomes low level when the value obtained by dividing the signal voltage from the terminal $P_{18d}$ becomes higher than the voltage of the peak holding capacitor 24, thereby detecting only ion current.

Figure 4:
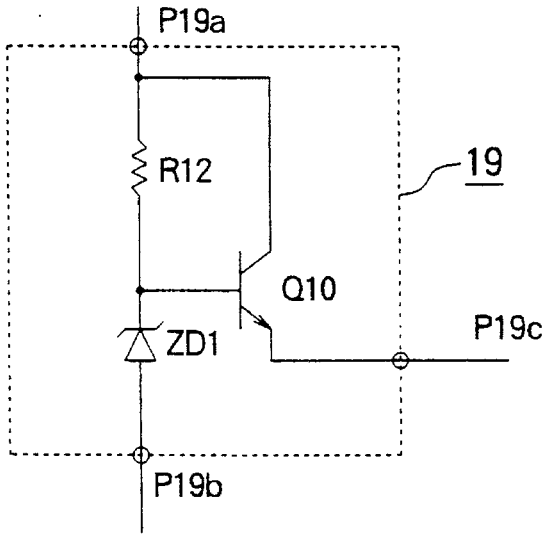
FIG. 4 is a diagram of a power supply circuit 19 provided in the first semiconductor integrated circuit 16 shown in FIG. 1.

The power supply circuit 19 in the first semiconductor integrated circuit 16 has a configuration such as that shown in FIG. 4.

A resistor R12 and a Zener diode ZD1 are connected in series between the terminal $P_{19a}$ connected to the power supply resistor 14 shown in FIG. 1 and the terminal $P_{19b}$ connected to the grounding conductor of the first semiconductor integrated circuit 16. A transistor Q10 is provided which has its base connected to a connection point between the resistor R12 and the Zener diode ZD1, its collector connected to the end of the resistor R12 on the terminal $P_{19a}$ side, and its emitter connected to the terminal $P_{19c}$. When the power supply voltage is higher than a certain level, the power supply circuit 19 sets the charging detection circuit 17 shown in FIG. 1 in the output possible state.

Figure 5:
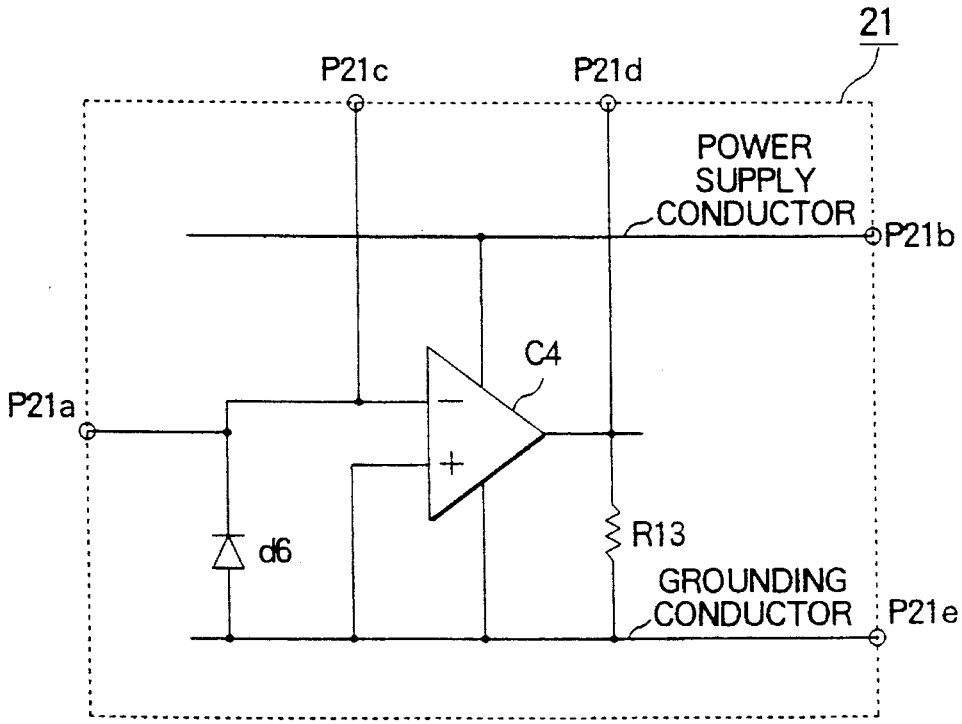
FIG. 5 is a diagram of an ion current-voltage converter circuit 21 provided in a second semiconductor integrated circuit 20 shown in FIG. 1.

The ion current-voltage converter circuit 21 in the second semiconductor integrated circuit 20 has a configuration such as that shown in FIG. 5.

The ion current-voltage converter circuit 21 has a comparator C4 which is supplied with power through a power supply conductor connected to its terminal $P_{21b}$ connected to the terminal $P_{17c}$ of the charging detection circuit 17 in the first semiconductor integrated circuit 16. The comparator C4 has its inverting input terminal connected to a terminal $P_{21a}$ which is connected to the low potential side of the biasing capacitor 6 shown in FIG. 1. The inverting input terminal is also connected to a terminal $P_{21c}$ which is connected to the feedback resistor 25 shown in FIG. 1. A diode d6 is provided having its anode connected to a grounding conductor of the ion current-voltage converter circuit 21. The grounding conductor is also connected to a terminal $P_{21e}$ and to the inverting input terminal of the comparator C4. The comparator C4 has its noninverting input terminal connected to the grounding conductor. The comparator C4 has its output terminal connected to the waveform shaping circuit 18 in the first semiconductor integrated circuit 16 shown in FIG. 1 and to the grounding conductor through a resistor R13. The grounding conductor is grounded through the diode 22, as shown in FIG. 1.

During the period of time when no control current is output from the first semiconductor integrated circuit 16, the substrate potential is not fixed since there is no passage for a current; the substrate potential is reduced along with the low potential side of the capacitor 6 by a value corresponding to the voltage held by the capacitor 6 so that no current flows through the capacitor 6. At this time, the voltage output from the ion current-voltage converter circuit 21 becomes equal to the substrate potential of the second semiconductor integrated circuit 20 and negative. Accordingly, no ion current flows through the second semiconductor integrated circuit 20.

On the other hand, during the period of time when control current is output from the first semiconductor integrated circuit 16, a current flows through the diode 22 so that the substrate potential of the semiconductor integrated circuit 20 is fixed higher by a value corresponding to a forward direction voltage $V_F$ (about 0.7 V) of the diode 22. During this period, the ion current-voltage converter circuit 21 makes current-voltage conversion to generate a voltage output superposed on the substrate potential.

That is, the output from the terminal $P_{20d}$ of the second semiconductor integrated circuit 20 and a terminal $P_{21d}$ of the ion current-voltage converter circuit 21 to the terminal $P_{18d}$ of the waveform shaping circuit 18 and the terminal $P_{16d}$ of the first semiconductor integrated circuit 16 is equal to the forward direction voltage $V_F$ if there is no ion current, and is $V_F+V_I$ ($V_I$ is an ion current-voltage conversion output) if there is an ion current.

Figure 6:
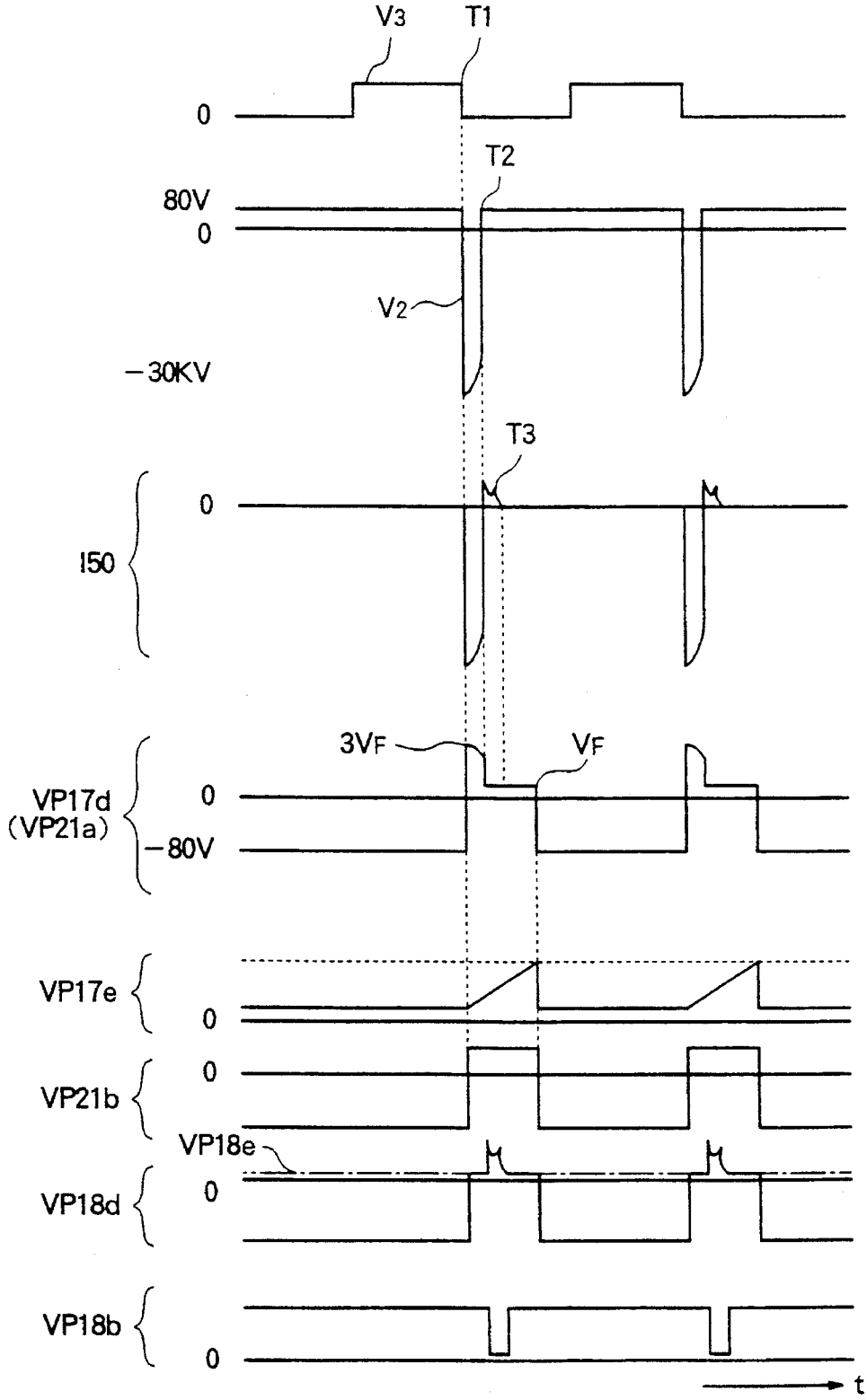
FIG. 6 is a waveform diagram of circuit portions showing the operation of the internal combustion engine misfire detection apparatus arranged as shown in FIGS. 1 through 5.
Figure 7:
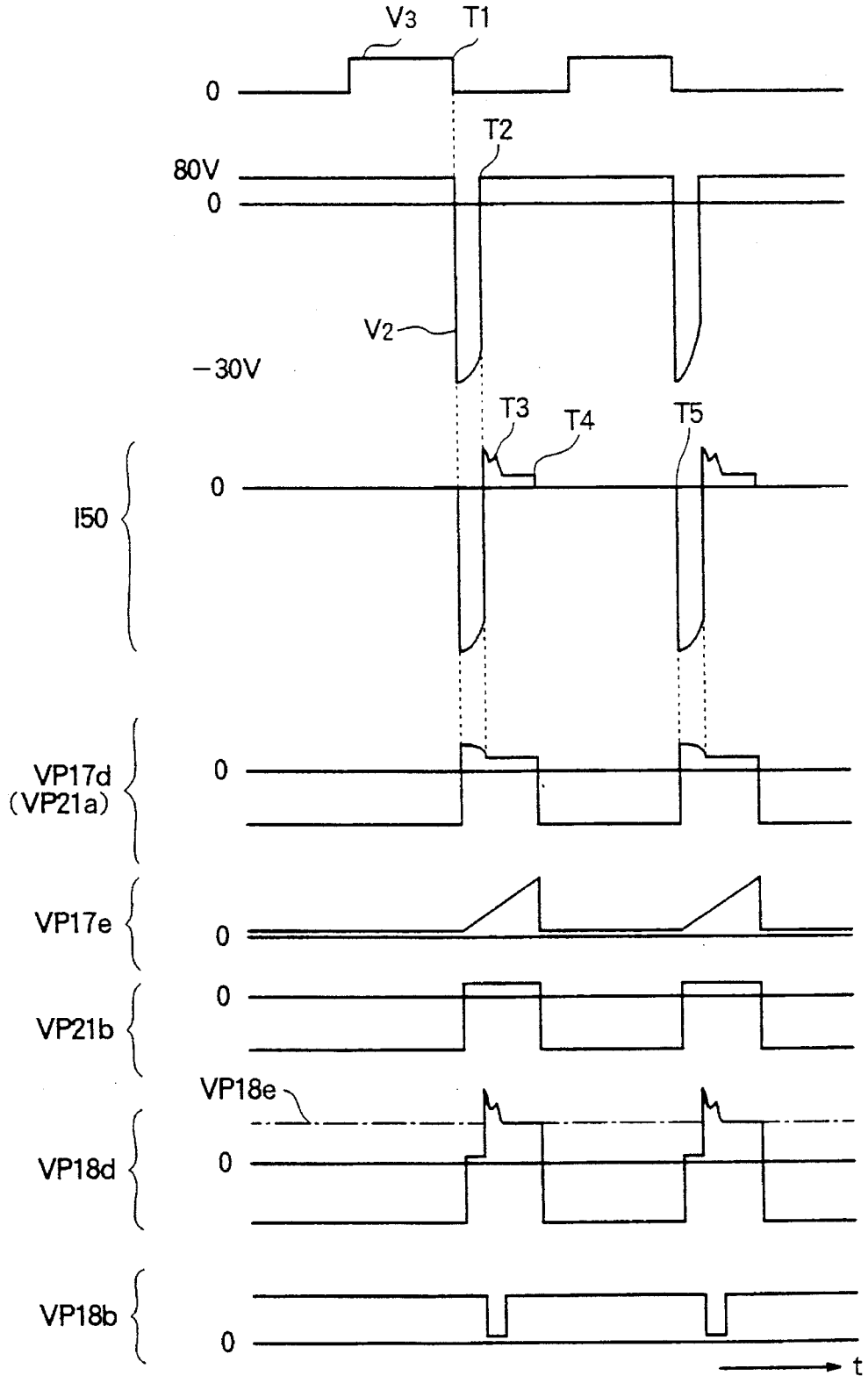
FIG. 7 is a waveform diagram showing the operation in a case where the insulation resistance of the ignition plug 2 shown in FIG. 1 is reduced in comparison with the operation shown in FIG. 6.

The control of the second semiconductor integrated circuit 20 by the first semiconductor integrated circuit 16 in the internal combustion engine misfire detection apparatus arranged as described above will now be described with reference to FIG. 6.

When the base voltage $V_3$ of the transistor 3 shown in FIG. 1 is controlled by the controller (not shown) to change the transistor 3 from the ON state to the OFF state (at a time T1 shown in FIG. 6), the potential $V_2$ of the ignition plug 2 is reduced to, for example, −30 V by the counter electromotive force of the coil, thereby causing a spark. At this time, a current is caused to flow in the direction opposite to arrow I50 in FIG. 1. This current charges the biasing capacitor 6 and flows into the charging detection circuit 17 in the first semiconductor integrated circuit 16.

The current flowing into the charging detection circuit having the configuration shown in FIG. 2 flows to the ground connection terminal through the diodes d1 to d3. The potential $V_{P17d}$ at the terminal $P_{17d}$ is increased by a value corresponding to a forward direction voltage $3V_F$ of these diodes. By the effect of this current, the transistor Q1 is turned on to turn off the transistors Q2 and Q3. The output of the comparator C1 is thereby changed from high level in a stable state to low level. Also, by the charging current output from the terminal $P_{17e}$, the time measuring capacitor 23 shown in FIG. 1 is charged and this charging is continued until the potential $V_{P17e}$ at the terminal $P_{17e}$ becomes equal to the voltage of the inverting input of the comparator C1. While the comparator C1 is maintaining its charging state, the transistor Q4 is turned off and the current from the constant-current circuit CC2 flows through the transistor Q6 to make the same conductive. With this operation, the pnp transistor Q7 is turned on to cause a current to flow from the terminal $P_{17c}$ to the terminal $P_{21b}$ of the ion current-voltage converter circuit 21 in the second semiconductor integrated circuit 20 shown in FIG. 1. The potential $V_{P21b}$ at the terminal $P_{21b}$ is thereby changed as shown in FIG. 6.

In the configuration of the ion current-voltage converter circuit 21 shown in FIG. 5, in accordance with the Kirchhoff's law, this current flows to the grounding terminal via the terminal $P_{21e}$ connected to the grounding conductor and via the diode 22 shown in FIG. 1 apart from a part flowing to the biasing capacitor 6 via the terminal $P_{21a}$ and another part flowing into the first semiconductor integrated circuit via the terminal $P_{21d}$ (this current returns to the terminal $P_{21c}$ by flowing through the feedback resistor 25 shown in FIG. 1. Accordingly, if the arrangement is such that the potential of the substrate of the second semiconductor integrated circuit 20 is set to the potential of the terminal $P_{21e}$, then the substrate potential of the second semiconductor integrated circuit 20 is fixed higher than that of the first semiconductor integrated circuit 16 by a value corresponding to the forward direction voltage $V_F$ (about 0.7 V) of the diode 22. At this time, the second semiconductor integrated circuit 20 is in the state of being capable of performing the current-voltage conversion operation. However, the state where charging current is generated by ignition is virtually such that a current flows in the direction opposite to ion current. Under this condition, the current-voltage conversion output is equal to the substrate potential of the second semiconductor integrated circuit 20.

Next, when ignition is terminated, the absolute value of the current I50 decreases abruptly and the voltage $V_2$ of the ignition plug 2 rises abruptly. If at this time an ion current occurs due to combustion, then the potential $V_{P18d}$ at the terminal $P_{18d}$ of the waveform shaping circuit 18, which results from the ion current as a voltage-current converted output from the ion current-voltage conversion circuit 21 in the second semiconductor integrated circuit 20, appears as shown in FIG. 6. The waveform shaping circuit 18 functions to separate the voltage waveform due to the ion current from this voltage signal. That is, in the configuration of the waveform shaping circuit 18 shown in FIG. 3, the input current to the peak holding capacitor 24 connected to the terminal $P_{18e}$ as shown in FIG. 1 depends upon the constant-current circuits CC3 and CC4 of the peak holding comparator C2 and the waveform shaping comparator C3 and is changed by the operation of the comparator C2.

If the constant-current values of the constant-current circuits CC3 and CC4 are ICC2 and ICC3, respectively, a current from the capacitor 24 flows in through the terminal $P_{18e}$ when the output of the peak holding comparator C2 is high, and the value of this current is |ICC2–ICC3|. On the other hand, when the output of the comparator C2 is low level, a current flows out to the capacitor 24 through the terminal $P_{18e}$, and the value of this current is |ICC3|. If |ICC3|>>|ICC2–ICC3| is satisfied, the capacitor 24 connected to the terminal $P_{18e}$ holds a peak value of the inverting input voltage of the peak holding comparator C2. However, |ICC3| is set to such a value that a rapidly-changing signal such as ion current cannot be followed. Then, the voltage at the terminal $P_{18e}$ has a level such as that shown in FIG. 6. The waveform shaping comparator C3 receives through its inverting input terminal a signal obtained by voltage-dividing the inverting input of the peak holding comparator C2 by the resistors R10 and R11, and receives through its noninverting input terminal the above-mentioned held peak voltage, thereby detecting only a signal higher than the held peak voltage at least by a certain value. When the voltage $V_{P18d}$ of the terminal $P_{18d}$ becomes higher than the voltage $V_{P18e}$ of the terminal $P_{18e}$, the waveform shaping comparator C3 sends out a low level output as output $V_{P18b}$ from the terminal $P_{18b}$, as shown in FIG. 6.

The operating waveforms in the case where the insulation resistance of the ignition plug 2 is reduced will be described in comparison with the operating waveforms shown in FIG. 6.

If a leak current occurs due to a reduction in the insulation resistance of the ignition plug 2, the ion current-voltage converter circuit 21 in the second semiconductor integrated circuit 20 operates so that the leak current is superposed on the ion current during the time period from T2 to T4. However, during the time period from T4 to T5 in which no control current to the second semiconductor integrated circuit 20 is generated by the control signal from the charging detection circuit 17, the voltages of the terminal $P_{17d}$ and $P_{21a}$ can drop to negative voltages, so that the current I50 becomes zero. Accordingly, the consumption of charge in the biasing capacitor 6 is reduced and the reduction in the biasing voltage to the ignition plug 2 becomes smaller.

Since the ion current-voltage converter circuit 21 converts the sum of an ion current and a leak current into a voltage, a voltage signal also appears in the voltage $V_{P18d}$ at the terminal $P_{18d}$ of the waveform shaping circuit 18 in the time period from T3 to T4 when there is no ion current. However, the arrangement is such that the potential level $V_{P17e}$ of the terminal $P_{17e}$ is set so as to be higher than the voltage level due to the leak current by the above-described peak holding operation. Therefore, only the ion current can be detected by comparison separately from the leak current as voltage $V_{P18b}$ at the terminal $P_{18b}$ output from the waveform shaping circuit 18.

In accordance with the present invention, as described above, the misfire detection circuit for detecting a misfire on the basis of detection of an ion current flowing through an ignition plug has a biasing capacitor which is charged with a current flowing through the ignition plug by discharge from the secondary coil, and which applies a voltage at which it has been changed to the ignition plug as a bias voltage, a charging voltage setting Zener diode connected between the high potential side of the capacitor and ground to set the voltage at which the capacitor is charged, a first semiconductor integrated circuit which is connected to the low potential side of the capacitor, which detects the charging current flowing through the capacitor and thereafter outputs a control current through a predetermined time period, which holds a peak value of a voltage converted from the ion current, and which detects the ion current by comparing the converted voltage value of the ion current and the held peak value, and a second semiconductor integrated circuit which has its substrate potential set higher than that of the first semiconductor integrated circuit, which is connected to the low potential side of the above-mentioned capacitor to supply a negative bias voltage to the same to reduce the potential at the low potential side of the capacitor by a value corresponding to the voltage held by the capacitor during the time period when the above-mentioned control current is not output, and which converts the ion current flowing through the capacitor into the voltage and outputs the converted voltage value. The bias voltage applied to the ignition plug is changed, the time period through which ion current detection is not made is provided and the voltage held by the biasing capacitor is prevented from dropping in this time period even if the insulation resistance of the ignition plug is reduced, whereby the current during the time period other than the ion current detection period can be reduced so that the consumption of accumulated charge in the biasing capacitor is smaller, with a result that the ion current and the leak current can easily be discriminated from each other so that the ion current detection accuracy is improved.

The above-described first semiconductor integrated circuit is provided with a charging detection circuit having an npn transistor which is turned on which the charging current flows through the biasing capacitor, a comparator which has an output change from high level to low level by the Operation of turning on the npn transistor, a time measuring capacitor which is charged when the output from the comparator is changed from high level to low level, which charging is continued until the output of the comparator is changed to high level, and a pnp transistor which outputs the control current to the second semiconductor integrated circuit when the output of the comparator is low level, thereby making it possible to apply a voltage lower than the substrate potential.

The above-described first semiconductor integrated circuit is also provided with a waveform shaping circuit having a peak holding comparator which receives, as an inverting input, the converted voltage value of the ion current output from the second semiconductor integrated circuit, and which also receives, as a noninverting input, a leak value of the converted voltage value. A peak holding capacitor is provided from which a current is caused to flow in when the output of this comparator is high level and to which a current is caused to flow out to hold the peak value of the converted voltage value of the ion current when the output of the comparator is low level to supply the noninverting input to the comparator. A waveform shaping comparator is provided which outputs an ion current detection signal by receiving as an inverting input a value obtained by dividing the voltage of the inverting input to the peak holding comparator by resistors, and by receiving as a noninverting input the value held by the peak holding capacitor, thereby making it possible to detect only the ion current.

Further, the second semiconductor integrated circuit is provided with an ion current-voltage converter circuit which has a diode connected between the low potential side of the biasing capacitor and a grounding conductor with its cathode connected to the grounding conductor, and a comparator having an inverting input terminal connected to the low potential side of the biasing capacitor, a feedback resistor being provided between the inverting input terminal and an output terminal, the comparator also having a noninverting input terminal connected to the grounding conductor. The ion current-voltage converter circuit supplies a negative bias to reduce the potential at the low potential side of the biasing capacitor by a value held by the biasing capacitor during the time period when the control current is not output from the first semiconductor integrated circuit. The ion current-voltage converter circuit also converts the ion current flowing through the biasing capacitor into a voltage and outputs the converted voltage value to the first semiconductor integrated circuit. The second semiconductor integrated circuit is also provided with a diode connected between the grounding conductor of said ion current-voltage converter circuit and ground with its anode connected to ground to set the substrate potential of the second semiconductor integrated circuit higher than the substrate potential of the first semiconductor integrated circuit. This arrangement is provided to negatively bias the substrate potential of the second semiconductor integrated circuit by the value corresponding to the voltage held by-the biasing capacitor during the time period when there is no need to detect the ion current, thereby making it possible to reduce the bias voltage to the ignition plug while maintaining the voltage held by the biasing capacitor.

What is claimed is:

1. An apparatus for detecting a misfire in an internal combustion engine comprising:

an ignition coil having a primary coil and a secondary coil, a power source being connected to one end of said primary coil, a switching device being connected to the other end of said primary coil and controlled to perform switching in accordance with the ignition timing of the internal combustion engine;

an ignition plug connected to one end of the secondary coil of said ignition coil and capable of causing a spark in a combustion chamber of the internal combustion engine to ignite an air-fuel mixture when a high voltage is applied to said ignition plug;

a biasing capacitor connected to the other end of said secondary coil, said biasing capacitor being charged with a current flowing through said ignition plug by discharge from said secondary coil, said biasing capacitor applying the voltage at which it has been charged by said charging to said ignition plug as a biasing voltage;

a Zener diode connected between a high potential side of said biasing capacitor and ground to set the voltage at which said biasing capacitor is charged;

a first semiconductor integrated circuit connected to the low potential side of said biasing capacitor, said first semiconductor integrated circuit detecting the charging current flowing through said biasing capacitor and thereafter outputting a control current through a predetermined time period, said first semiconductor integrated circuit also holding a peak value of a voltage converted from the ion current and detecting the ion current by comparing the converted voltage value of the ion current and the held peak value; and a second semiconductor integrated circuit having a substrate potential set higher than a substrate potential of said first semiconductor integrated circuit, said second semiconductor integrated circuit being connected to the low potential side of said biasing capacitor to supply a negative bias voltage to said biasing capacitor to reduce the potential at the low potential side of the capacitor by a value corresponding to the voltage held by said biasing capacitor during a time period when said control current is not output, said second semiconductor integrated circuit converting the ion current due to combustion caused by said ignition plug into a voltage and outputting the converted voltage value.

2. An apparatus according to claim 1 wherein said first semiconductor integrated circuit comprises a charging detection circuit which is connected to the low potential side of said biasing capacitor, and which detects the charging current flowing through said biasing capacitor and thereafter outputs the control current for the predetermined time period.

3. An apparatus according to claim 2 wherein said charging detection circuit includes:

switching means capable of being turned on when the charging current flows through said biasing capacitor;

charging control means having an output changed from high level to low level by the operation of turning on said switching means to charge a time measuring capacitor connected to an output terminal, said charging control means maintaining the charging state until the output is changed to high level; and control current output means for outputting the control current to said second semiconductor integrated circuit when the output of said charging control means is low level.

4. An apparatus according to claim 3 wherein said switching means includes:

a series combination of first to third diodes provided between said biasing capacitor and a grounding conductor;

a series combination of first and second resistors provided between a connection point between said first and second diodes and said grounding conductor; and a first npn transistor having its base connected to the connection point between said first and second resistors and its emitter connected to said grounding conductor, said first npn transistor being turned on when the charging current flows through said biasing capacitor.

5. An apparatus according to claim 3 wherein said charging control means includes:

a second npn transistor having its base connected to an output terminal of said switching means through a third fourth resistor, its collector connected to a connection point between fifth and sixth resistors connected in series between a power supply conductor and a grounding conductor, and its emitter connected to said grounding conductor;

a third npn transistor having its collector connected to said power supply conductor through a series combination of a first constant-current circuit and a fourth diode, its emitter connected to said grounding conductor, and its base connected to said output terminal of said switching means through a fourth resistor; and a comparator having a noninverting input terminal connected to a connection point in said series combination of said first constant-current circuit and said fourth diode and to the output terminal to which said time measuring capacitor is connected, said comparator also having an inverting input terminal connected to the collector of said second npn transistor, said comparator being connected to said power supply conductor through a seventh resistor, said comparator having an output terminal connected to the bases of said second and third npn transistors through said third and fourth resistors, an output of said comparator being changed from high level to low level by the operation of turning on the output of said switching means to turn off said second and third npn transistors and to charge said time measuring capacitor from said first constant-current circuit, said comparator continuing charging until the output is changed to high level.

6. An apparatus according to claim 3 wherein said control current output means includes:

a fourth npn transistor having its base connected to the output terminal of said charging control means through an eighth resistor, its collector connected to a power supply conductor through a second constant-current circuit, and its emitter connected to a grounding conductor;

a fifth npn transistor having its base connected to the output terminal of said charging control means through said eighth resistor, and its collector and emitter connected to the same connection points as the collector and emitter of said fourth npn transistor;

a sixth npn transistor having its base and emitter connected to the same connection points as the base and emitter of said fifth npn transistor, and its collector connected through a ninth resistor to a terminal connected to said power source; and a seventh pnp transistor having its base connected to the collector of said sixth npn transistor, its emitter connected to an end of said ninth resistor opposite from the end of the same to which its base is connected, and its collector connected to a terminal connected to said second semiconductor integrated circuit, said seventh transistor outputting the control current to said second semiconductor integrated circuit when the output from said comparator is low level.

7. An apparatus according to claim 1 wherein said first semiconductor integrated circuit comprises a waveform shaping circuit which holds a peak value of the converted voltage value of the ion current output from said second semiconductor integrated circuit, and which detects the ion current by comparing the converted voltage value of the ion current and the held peak value.

8. An apparatus according to claim 7 wherein said waveform shaping circuit includes:

peak holding means receiving as an inverting input the converted voltage value of the ion current output from said second semiconductor integrated circuit and receiving as a noninverting input a value held by a peak holding capacitor, said peak holding means causing a current to flow in through an output terminal connected to said peak holding capacitor when its output is high level, said peak holding means causing a current to flow out through the output terminal to hold the peak value of the converted voltage value of the ion current when its output is low level; and waveform shaping output means for outputting an ion current detection signal by receiving as-an inverting input a value obtained by dividing the voltage of the inverting input to said peak holding means, and by receiving as a noninverting input the value held by said peak holding capacitor.

9. An apparatus according to claim 8 wherein said peak holding means includes:

a peak holding comparator which receives as an inverting input the converted voltage value of the ion current output from said second semiconductor integrated circuit through a fifth diode, and which receives as a noninverting input the value held by said peak holding capacitor;

an eighth npn transistor having its collector connected to a power supply conductor through a third constant-current circuit and to an output terminal of said peak holding comparator and its emitter connected to a grounding conductor and having fits base and collector short-circuited; and a ninth npn transistor having its base and emitter connected to the same connection points as the base and emitter of said eighth npn transistor, and having its collector connected to said power supply conductor through a fourth constant-current circuit and to a noninverting input terminal of said peak holding comparator and said peak holding capacitor.

10. An apparatus according to claim 8 wherein said waveform shaping output means includes:

a series combination of tenth and eleventh resistors provided between an inverting input terminal of said peak holding means and a and a grounding conductor; and a waveform shaping comparator which outputs an ion current detection signal by receiving as an inverting input a value obtained by dividing the voltage of the inverting input to said peak holding means by said series combination of said resistors, and by receiving as a noninverting input the value held by said peak holding capacitor.

11. An apparatus according to claim 1 wherein said first semiconductor integrated circuit comprises a power supply circuit connected to said power source through a power supply resistor, said power supply circuit having:

a series combination of a twelfth resistor and a Zener diode connected between said power supply resistor and a grounding conductor; and a tenth npn transistor having its base connected a connection point in said series combination, its collector connected to an end of said twelfth resistor opposite from the end of the same connected to said Zener diode, and its emitter connected to a power supply output terminal.

12. An apparatus according to claim 1 wherein said second semiconductor integrated circuit comprises:

an ion current-voltage converter circuit having a diode connected between the low potential side of said biasing capacitor and a grounding conductor with its cathode connected to said grounding conductor, and a comparator having an inverting input terminal connected to the low potential side of said biasing capacitor, a feedback resistor being provided between said inverting input terminal and an output terminal, said comparator also having a noninverting input terminal connected to said grounding conductor, said ion current-voltage converter circuit supplying a negative bias to reduce the potential at the low potential side of said biasing capacitor by a value held by said biasing capacitor during the time period when the control current is not output from said first semiconductor integrated circuit, said ion current-voltage converter circuit converting the ion current flowing through said biasing capacitor into a voltage and outputting the converted voltage value to said first semiconductor integrated circuit; and a diode connected between the grounding conductor of said ion current-voltage converter circuit and ground with its anode connected to ground to set the substrate potential of said second semiconductor integrated circuit higher than the substrate potential of said first semiconductor integrated circuit.

* * * * *